US006886483B2

(12) United States Patent
Kiss

(10) Patent No.: US 6,886,483 B2
(45) Date of Patent: May 3, 2005

(54) SAIL AND METHOD OF MANUFACTURE THEREOF

(76) Inventor: Aaron Kiss, P.O. Box 7273, Ft. Lauderdale, FL (US) 33338

( * ) Notice: Subject to any disclaimer, the term of this patent is extended or adjusted under 35 U.S.C. 154(b) by 0 days.

(21) Appl. No.: 10/623,822

(22) Filed: Jul. 21, 2003

(65) Prior Publication Data

US 2004/0016381 A1 Jan. 29, 2004

Related U.S. Application Data

(63) Continuation of application No. 09/834,986, filed on Apr. 14, 2001, now Pat. No. 6,622,648.

(51) Int. Cl.[7] ..... B63H 9/04

(52) U.S. Cl. ..... 114/102.29; 114/102.22; 114/102.31

(58) Field of Search ..... 114/102.22, 102.23, 114/102.29, 102.31, 102.33; 428/108–113

(56) References Cited

U.S. PATENT DOCUMENTS

| | | | | | |
|---|---|---|---|---|---|
| 2,565,219 | A | * | 8/1951 | Gardiner et al. | 114/102.33 |
| 2,706,699 | A | * | 4/1955 | Plansoen et al. | 156/324 |
| 4,443,516 | A | * | 4/1984 | Rogers | 442/312 |
| 4,444,822 | A | * | 4/1984 | Doyle et al. | 428/109 |
| 4,615,934 | A | * | 10/1986 | Ellison | 442/313 |
| 4,656,080 | A | * | 4/1987 | Takahashi et al. | 428/215 |
| 4,679,519 | A | * | 7/1987 | Linville | 114/102.31 |
| 4,801,491 | A | * | 1/1989 | Tanaka et al. | 428/212 |
| 5,001,003 | A | * | 3/1991 | Mahr | 442/41 |
| 5,061,553 | A | | 10/1991 | Olsen, Jr. | |
| 5,073,441 | A | * | 12/1991 | Melec et al. | 442/1 |
| 5,147,714 | A | * | 9/1992 | Ellison et al. | 442/313 |
| 5,221,569 | A | * | 6/1993 | Rohrka et al. | 428/215 |
| 5,333,568 | A | * | 8/1994 | Meldner et al. | 114/102.31 |
| 5,365,491 | A | | 11/1994 | Sullivan et al. | |
| 5,403,641 | A | * | 4/1995 | Linville et al. | 428/113 |
| 6,280,546 | B1 | | 8/2001 | Holland et al. | |
| 6,622,648 | B2 | * | 9/2003 | Kiss | 114/102.29 |
| 6,624,098 | B1 | * | 9/2003 | Mahr | 442/208 |

FOREIGN PATENT DOCUMENTS

| | | | | |
|---|---|---|---|---|
| EP | 222610 A | * | 5/1987 | B32B/5/02 |
| FR | 2486017 A | * | 1/1982 | B63B/35/72 |
| JP | 61078643 A | * | 4/1986 | B32B/27/12 |
| JP | 61255854 A | * | 11/1986 | B32B/27/12 |
| JP | 03108536 A | * | 5/1991 | B32B/27/12 |

OTHER PUBLICATIONS

Graphics for Sails; Internet Web site http://na.northsails.com and http://www.northsails.com/graphics.*

Sailing Graphics; Internet Web site http://www.sailing–graphics.com.*

* cited by examiner

*Primary Examiner*—S. Joseph Morano
*Assistant Examiner*—Ajay Vasudeva
(74) *Attorney, Agent, or Firm*—Kevin P. Crosby, Esq.; Daniel C. Crilly, Esq.; Brinkley, McNerney, et al.

(57) ABSTRACT

A sailboat sail includes a sheet of material that contains stretchable webs that assume a planar orientation when placed against a planar surface, but which can stretch into a sail or airfoil orientation when mounted to a sailboat and exposed to wind loading. The sheet includes at least two webs of PVC vinyl laminated together between which is disposed a scrim of polyester yarn. The yarn is cross-hatched in a predetermined directional pattern. The sail has informational content, such as advertising, printed thereon or otherwise imparted thereto. A method for manufacturing such a sail includes providing a sheet of the aforementioned sail material, printing on one or both sides of the sheet information content to be displayed while the sail is mounted upon a sailboat, and cutting the sheet into the shape of a sail. The sheet may be cut before or after the information is imprinted thereon.

14 Claims, 3 Drawing Sheets

SAIL AND METHOD OF MANUFACTURE THEREOF

CROSS-REFERENCE TO RELATED APPLICATIONS

This application is a continuation of U.S. patent application Ser. No. 09/834,986 filed on Apr. 14, 2001, now U.S. Pat. No. 6,622,648 and hereby claims priority upon such application under 35 U.S.C. § 120.

BACKGROUND OF THE INVENTION

1. Field of the Invention

This invention relates to aerodynamic lift devices and, more particularly, to sailboat sails adapted to bear printed informational content.

2. Description of the Background Art

Industrious marketers routinely look for innovative ways to convey information, particularly information in the form of advertisements. Traditional forms of advertisement, i.e. print advertisement in periodical publications and television and radio advertising, flourish in the electronic age. With the advent of the Internet, advertisers have found an additional means of advertising, instantaneously, on a worldwide basis.

However, the advent of the electronic age has not ended the romance and relaxation associated with vacationing and/or leisuring near bodies of water. A significant portion of the population of humans on this planet repose at some time or another in their lives near lake and sea shores. For many of these vacationers and local residents alike, such time spent, whether brief or long-lasting, is accompanied by an overwhelming sense of awareness and relaxation of the surroundings, yielding one of the most significant opportunities for advertisers to ingratiate their messages and information into the memories of those near the water.

Unfortunately, the ability and right to physically place informational messages, e.g. advertisements, before vacationers and local residents near the water is severely limited by environmental factors and laws which limit or completely prohibit advertising structures such as billboards and other signs. Since those recreating near the water inevitably face the water, any land-based structures are for the most part directly behind beachgoers and therefore only seen for a small amount of time.

The use of banner planes, which fly translucent or transparent banners bearing messages which can only be read on one side, only provide limited exposure due to the fact that they are typically required to fly some distance offshore and fly at speeds in excess of 100 or more miles per hour. As a result, the banners are only in front of the eyes of each particular viewer for a brief time.

Therefore, a conveniently deployed information dissemination system is needed which does not require the construction of a permanent fixture in the water and which can be selectively maintained essentially in fixed position or moved very slowly before areas on the shore which happen to have the highest concentration of people at a given time.

SUMMARY OF THE INVENTION

It is, therefore, a principal object of this invention to provide an advertising system which exposes informational messages to virtually any land area near a lake or seashore.

It is also an object of this invention to provide a novel sailboat sail on which can be imprinted photorealistic informational content using an extremely inexpensive sail material and widely-used printing technique.

These and other objects are accomplished through the use of a sailboat flying one or more sails, which sails have imprinted thereon informational content, such as consumer advertising. The sail material is chosen from a group of materials which lay completely flat, i.e. planar, when laid against a planar surface, but which stretch under wind loading when attached to a sailboat to form the conventional airfoil shape desirable of a sail. By choosing sail material which stretches between a completely flat, planar, orientation when not exposed to aerodynamic forces, conventional printing techniques can be utilized to print the information thereupon. With the advent of large printing apparatuses which can produce very large, photorealistic, imagery, such as product photographs and logos, the process of printing upon the sail material is greatly simplified. Attempts to print, paint, etc. such images upon sails having "draft", that is, sails which have more linear feet of sail material between the luff and the leech than the actual distance between the luff and the leech, have invariably resulted in distorted images as the draft of the sail opens up under wind loading. Any attempt whatsoever to compensate for such distortion during the printing process would be extremely complex and, consequently, cost-prohibitive.

Certainly the most desirable sail on a sailboat to portray informational content upon is the jib. However, the larger the draft of the jib made out of prior art material, the more difficult it is to print upon due to the amount of sagging in the sail material in its flaccid state. The same is true for any sail, e.g. mainsail, inner staysail, etc.

To overcome these disadvantages, a combination sail and information content conveying medium is proposed. In the preferred embodiment, the sail material is a laminated banner opaque vinyl having polyester yarn scrim, preferably in a cross-hatched orientation, but other orientations will work just as well. When the sail material is laid flat upon a horizontal planar surface, it can be printed upon with ease. Since some sails are larger than existing printers can accommodate due to the flattened nature of the material, plural sheets can be printed upon and combined, such as by stitching or pressurized heat seaming, or otherwise combined, along edges of the sheets so as to cover the entire sail. In use, due to the elastic nature of the material, a "draft" is created in the sail by aerodynamic forces causing the sail to assume an airfoil shape which drives the vessel through the water in the same manner as occurs when a conventional sail is used. Batten pockets covered with the artwork corresponding to those sections of the sail where batten pockets are desired may be applied, again by stitching, heat seaming or the like.

The use of a material chosen from the group of materials disclosed herein has exhibited the surprising result of performance comparable to standard Mylar®, Kevlar, etc. sails, but upon which can be printed or otherwise imparted amazingly photorealistically detailed images of products and/or other informational content which is visible literally for miles on a relatively slow moving vessel. As a result, the number and duration of advertising impressions among beachgoers is far greater than any other advertising medium ever used before.

There is also disclosed herein a novel method for manufacturing such a sail. The method is comprised of the following steps:

(a) providing a flat sheet of stretchable material having a denier, grab tensile strength (stretch factor) and tongue tear (point of failure after puncture) sufficient to suitably hold together and function as a sail under normal near-shore sailing conditions;

(b) printing on one or both sides of the flat sheet information content to be displayed while the sail is mounted upon a sailboat;

(c) cutting the flat sheet into the shape of a sail.

The steps of printing and cutting may be interchanged should the flat sheet already be cut into the shape of a sail. That is, the step of printing the informational content onto the flat sheet can be done after the sheet has been cut into the shape of a sail or portion thereof. Thereafter, grommets, reefing lines, etc. can be attached.

The invention will be best understood in connection with the accompanying drawings and from a consideration of the following detailed description in which corresponding parts are indicated by corresponding numerals.

DESCRIPTION OF A PREFERRED EMBODIMENT

Figure 1:
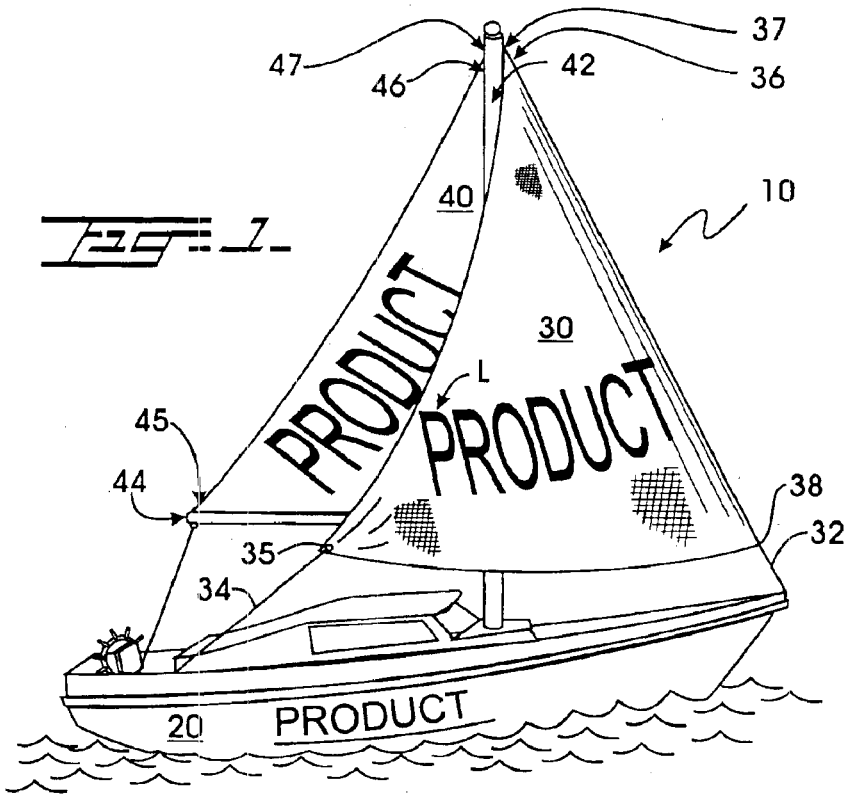
FIG. 1 is a perspective view of a sailing vessel employing sails in accordance with the instant invention.
Figure 2:
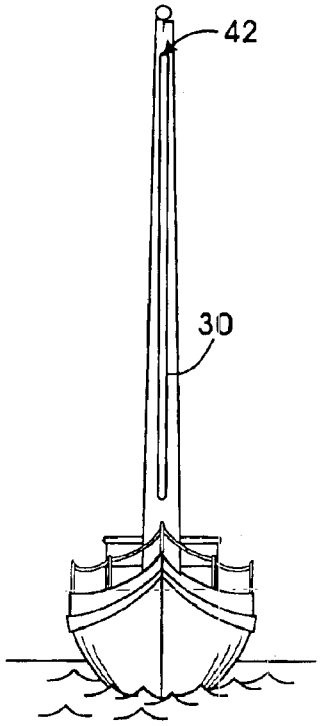
FIG. 2 is a head-on elevational view of the sailing vessel under conditions where there is no wind loading.
Figure 3:
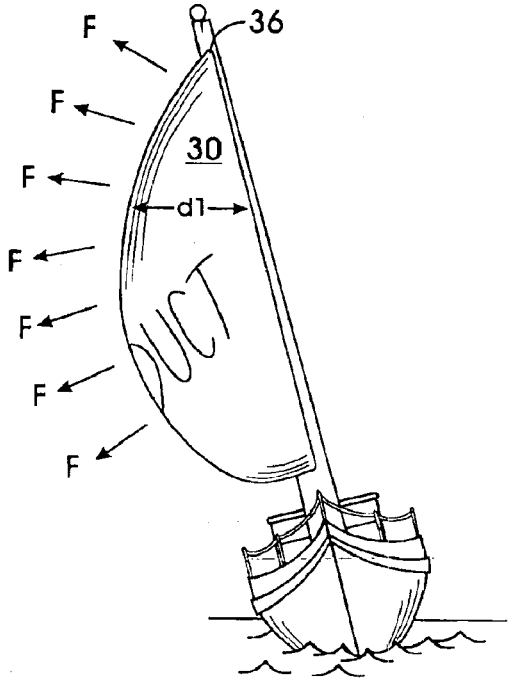
FIG. 3 is a head-on elevational view of the sailing vessel under wind loading.
Figure 4:
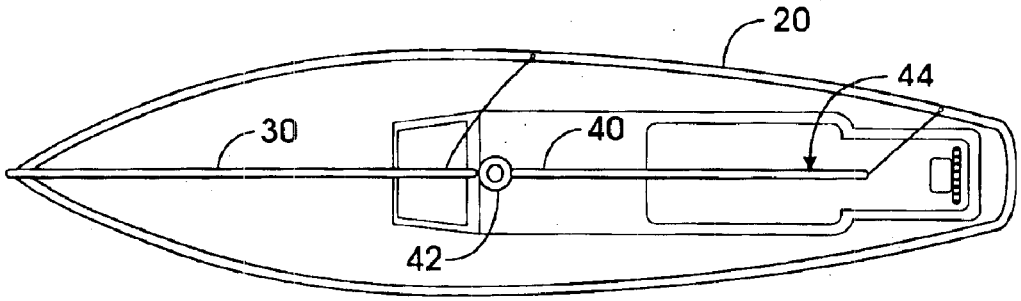
FIG. 4 is a top plan view of the vessel under the conditions shown in FIG. 2.
Figure 5:
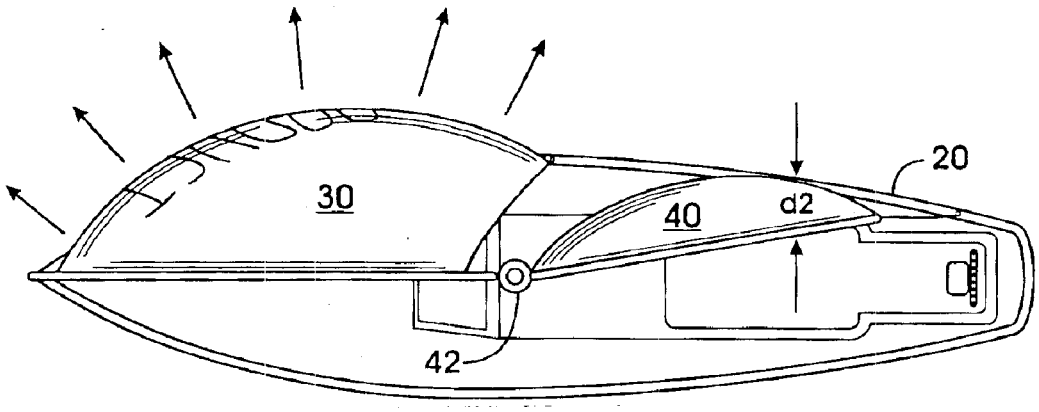
FIG. 5 is a top plan view of the vessel under the conditions shown in FIG. 3.

The invention is directed to a sailboat sail apparatus and method for manufacturing thereof. FIGS. 1 through 5 depict such a sail apparatus employed on a typical sailing vessel. FIGS. 2 and 4 show the vessel 20 under zero wind load such that the sail material of headsail 30 and mainsail 40 are not exposed to wind loading and, consequently, in accordance with the invention lie essentially flat. FIGS. 1, 3 and 5 show vessel 20, headsail 30 and mainsail 40 exposed to wind loading such that headsail 30 is stretched to assume draft $d_1$ and mainsail 40 assumes draft $d_2$. As a result of sails 30 and 40 being stretchable into the configuration shown, they form airfoils such that vessel 20 is driven through the water as a result of the aerodynamic lift forces F exerted upon the sails.

Figure 6:
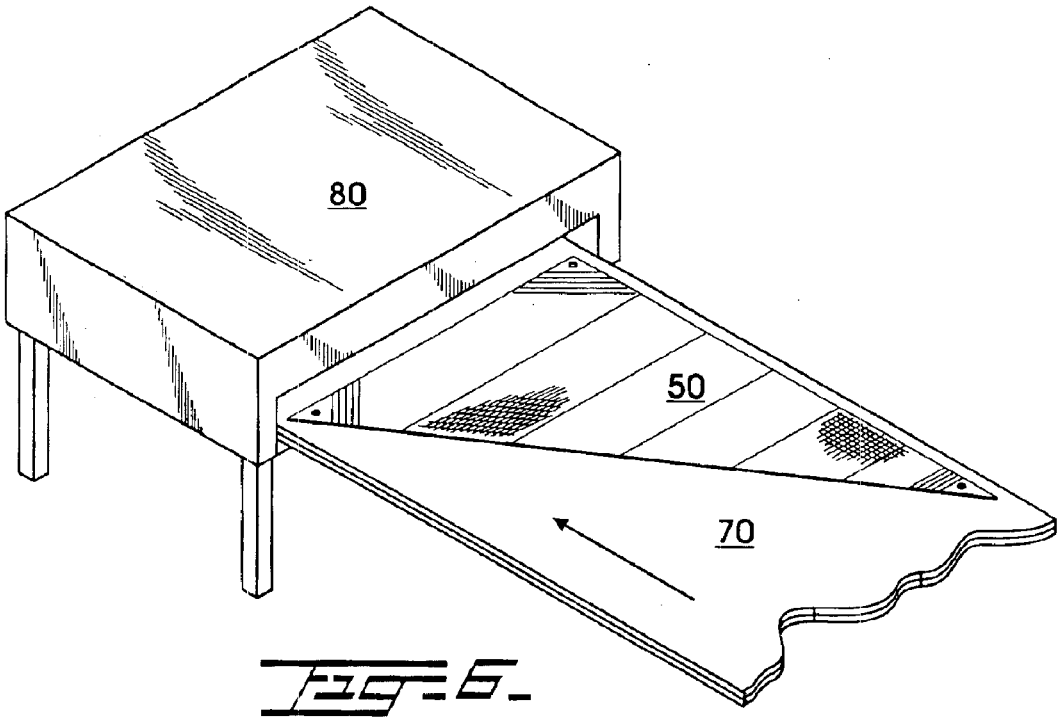
FIG. 6 is a perspective view of an exemplary apparatus used to print informational content upon the sail material.

FIG. 6 shows a step in the process of printing informational material upon a flat sheet of material 50 which includes a conveyor platform 70 upon which sheet 50 is laid in planar fashion. Essentially, all points of sheet 50 are in contact with conveyor platform 70. A printing apparatus 80, which may be one of many known in the art, is used to impart the informational material onto sheet 50 via any known printing method. The informational material may be imprinted on one side of sheet 50 or both sides. Alternatively, different informational content maybe placed on either side of sheet 50.

The sheet 50 shown in FIG. 6 is already cut into the shape of a sail such as mainsail 40. As an alternative, flat rectangular sheets of material 50 may be employed and later cut into the shape of sails or portions of sails. In the case where such material is cut into the shapes of portions of sails, those portions can be joined together to form a larger, complete, sail in cases where the printing apparatus 80 cannot accommodate the entire sail plan for a particular sail. Or, since the type of material which may be utilized for the sail of the instant invention is typically manufactured in rectangular sheets, such sheets can be printed upon in a rectangular sheet and later cut into the shape of an entire sail in the event that printing apparatus 80 can accommodate sheets of sufficient size.

The method of the instant invention, in its preferred form, comprises providing a flat sheet of the material taken from the group consisting of stretchable sheet material which can be laid flat upon a planar surface for printing but which can stretch into the draft shape of a common sailboat sail to create aerodynamic lift to drive the sailboat; printing on one or both sides of said sheet; and assembling a plurality of such sheets into a sail or cutting said sheet into the shape of a sail.

Alternatively, the planar sheet of sail material may be pre-cut into the shape of the sail or portion of a sail and thereafter printed upon.

In addition, various fittings and other hardware may be affixed to or associated with any one of sails 30, 40, 50, etc. as will occur to those skilled in the field.

EXAMPLE

Figure 7:
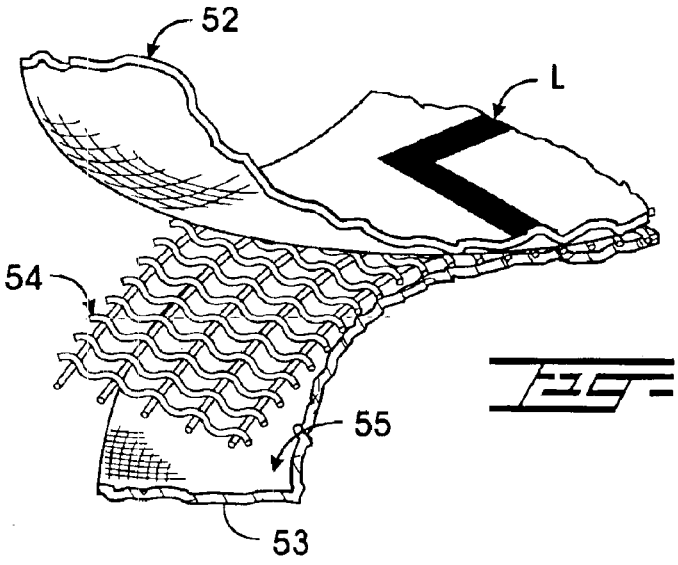
FIG. 7 is a partially exploded view of the preferred embodiment of the sail material adapted for use with the invention.

A sail in accordance with the instant invention was manufactured using 15/16 laminated banner vinyl supplied by Value Vinyls, Inc. of Arlington, Tex. The weight of the material is approximately 15/16 ounces per square yard, and is provided in standard widths of either 36 inches, 54 inches or 72 inches. The preferred material, which is shown in exploded detail in FIG. 7, preferably comprises at least two sheets of PVC vinyl 52, 53 sandwiching a scrim 54 of crosshatched polyester yarn of approximately 9×9 count per square inch and a denier of 1,000. The grab tensile strength of the material at breaking point is 218 pounds per inch in one direction and 195 pounds per inch in a perpendicular direction. The tongue tear, or point of rupture after puncture when a 90 degree pull is exerted thereupon, is 70 pounds in one direction and 66 pounds in a perpendicular direction. The adhesion strength of the multiple layers of vinyl laminate is 20 pounds per each two inches of length, which is the amount of force required to separate the layers 52, 53 from one another. A matte finish was provided to the material prior to printing. Also, preferably but not by way of limitation, an opaque light barrier sheet may be employed between the scrim 54 and at least one of the sheets of PVC vinyl 52, 53, such as sheet 55, to prevent light from passing through the sail as illustrated in FIG. 7.

The sail of the preferred embodiment is comprised of a material which lays flat at substantially all points when not exposed to wind loading but which assumes an airfoil shape with corresponding sail draft $d_1$, $d_2$, etc. when mounted to a sailing vessel in any known manner and exposed to wind loading. The sail as described further includes informational matter L thereupon (e.g., on an outer surface of the PVC layer 52 as illustrated in FIG. 7), such as textual informational matter, images, or any combination thereof. The sail is ideally suited for advertisement when utilized on near-shore sailing vessels.

As an example but not by way of limitation, headsail 30 is connected at its forward edge to forestay 32, at its head end 36 to a halyard which is reciprocally movable up and down mast 42. A jib sheet 34 is connected to clew 35 of headsail 30 to control the profile thereof under wind loading. Mast 42 also supports the leading edge or "luff" of mainsail 40, the head 46 thereof being attached to a mainsail halyard 47 and the clew 45 thereof being connected to boom 44.

The instant invention has been disclosed in its most and practical and preferred embodiment. However, the invention is not restricted to the illustrative examples described above and illustrated in the drawings, but may be modified within the scope of the following claims without departing from the intended scope of the invention. The material is preferably opaque such that matter printed on one side will not show through to the other. This facilitates printing of independent matter of either side of the sheet.

What is claimed is:

1. A sail formed by a process comprising steps of:

providing a sheet of material containing stretchable webs that lay substantially flat when disposed against a planar surface, but which are capable of stretching under wind loading to assume a sail or airfoil shape, the sheet including at least two webs of PVC vinyl laminated together between which is disposed a scrim of polyester yarn, the yarn being cross-hatched in a predetermined directional pattern, the sheet of material further including an opaque barrier sheet disposed between the scrim and at least one of the webs of PVC vinyl;

printing informational matter onto the sheet; and cutting the sheet into the shape of a sailboat sail.

2. The sail of claim 1, wherein the sail is at least one of a headsail and a mainsail.

3. The sail of claim 1, wherein the information matter is printed onto the sheet by printing the informational matter onto an outer surface of at least one of the web of PVC vinyl.

4. The sail of claim 1, wherein the weight of the sheet is in the range of 10 to 30 ounces per square yard.

5. The sail of claim 1, wherein the sheet of material is opaque.

6. The sail of claim 1, wherein the informational matter is printed onto the sheet by printing the informational matter on both sides of the sheet.

7. A sail comprising:

a sheet of material in the shape of a sail adapted to be functionally employed on a sailboat, the material containing stretchable webs that assume a planar orientation when placed against a planar surface, but which can stretch into a sail or airfoil orientation when mounted to a sailboat and exposed to wind loading, the sheet of material including at least two webs of PVC vinyl laminated together between which is disposed a scrim of polyester yarn, the yarn being cross-hatched in a predetermined directional pattern, the sheet of material further including an opaque barrier sheet disposed between the scrim and at least one of the webs of PVC vinyl; and printed informational matter disposed on at least a portion of at least one surface of the sheet.

8. The sail of claim 7, wherein the printed informational matter is disposed on both sides of the sheet.

9. The sail of claim 7, wherein the informational matter includes at least one of textual information and graphics.

10. The sail of claim 7, wherein the sheet of material is opaque.

11. A sail formed by a process comprising steps of:

providing a plurality of sheets of material, each sheet of material containing stretchable webs that lay substantially flat when disposed against a planar surface, but which are capable of stretching under wind loading to assume a sail or airfoil shape, each sheet of material including at least two webs of PVC vinyl laminated together between which is disposed a scrim of polyester yarn, the yarn being cross-hatched in a predetermined directional pattern, each sheet of material further including an opaque barrier sheet disposed between the scrim and at least one of the webs of PVC vinyl;

printing informational matter onto each sheet; and assembling the plurality of sheets into the shape of a sailboat sail.

12. The sail of claim 11, wherein the adhesion strength of the two webs of PVC vinyl when laminated together is 20 pounds per two inches of length.

13. The sail of claim 11, wherein each sheet of material is opaque.

14. The sail of claim 11, wherein the informational matter is printed onto each sheet by printing the informational matter on both sides of each sheet.

* * * * *